US005720851A

United States Patent [19]

Reiner

[11] Patent Number: 5,720,851

[45] Date of Patent: Feb. 24, 1998

[54] METHOD AND ARRANGEMENT FOR PRODUCING A FOAM-FORMED FIBRE OR PAPER WEB

[75] Inventor: Lennart Reiner, Matfors, Sweden

[73] Assignee: SCA Hygiene Paper AB, Gothenburg, Sweden

[21] Appl. No.: 750,863

[22] PCT Filed: Jul. 12, 1995

[86] PCT No.: PCT/SE93/00848

§ 371 Date: Jan. 15, 1997

§ 102(e) Date: Jan. 15, 1997

[87] PCT Pub. No.: WO96/02702

PCT Pub. Date: Feb. 1, 1996

[30] Foreign Application Priority Data

Jul. 13, 1994 [SE] Sweden ..... 9402469

[51] Int. Cl.[6] ..... D21D 3/00

[52] U.S. Cl. ..... 162/101; 162/190; 162/264; 162/289

[58] Field of Search ..... 162/101, 190, 162/264, 322, 289, 380

[56] References Cited

U.S. PATENT DOCUMENTS 4,443,297 4/1984 Cheshire et al. ..... 162/101
4,498,956 2/1985 Cheshire et al. ..... 162/101
4,543,156 9/1985 Cheshire et al. ..... 162/264
4,686,006 8/1987 Cheshire et al. ..... 162/101
4,944,843 7/1990 Wallace et al. ..... 162/264

FOREIGN PATENT DOCUMENTS 1329409 9/1973 United Kingdom .

*Primary Examiner*—Peter Chin
*Attorney, Agent, or Firm*—Burns, Doane, Swecker & Mathis LLP

[57] ABSTRACT

Method of producing a foam-formed fibre or paper web, whereby a foamed fibre dispersion is formed by dispersing natural and/or synthetic fibres in a foamable liquid comprising water and a tenside in a dispersion vessel (111) and by conveying the foamed fibre dispersion to a wire (118) on a paper machine. The foamed liquid which is removed through the wire (118) is conveyed to a closed foam tank (128) in which a draining of the liquid to the bottom of the tank occurs, whilst the lighter foam is collected in the top of the foam tank. Liquid from the bottom of the foam tank is led to the dispersion vessel (111) via a first pipeline (129), whilst foam passes to the dispersion vessel via a second pipeline (130) in the top of the foam tank where the fibres are added and dispersed in the foamable liquid.

20 Claims, 2 Drawing Sheets

METHOD AND ARRANGEMENT FOR PRODUCING A FOAM-FORMED FIBRE OR PAPER WEB

FIELD OF THE INVENTION

The present invention relates to a method of producing a foam-formed fibre or paper web, whereby a foamed fibre dispersion is formed by dispersing natural and/or synthetic fibres in a foamable liquid comprising water and a tenside in a dispersion vessel and by conveying the foamed fibre dispersion to a wire on a paper machine.

BACKGROUND TO THE INVENTION

Paper webs and other wet-laid fibre webs are normally produced by starting from pulp or other fibres in bale form and forming a fibre furnish in a carrier medium, normally water, by mechanical processing in a breaker vessel. Water addition is effected in order to regulate the fibre concentration to the desired level. Sometimes chemicals are also added. The fibre furnish is transferred from the breaker to vats for additional dilution before being conveyed to the inlet box of the paper machine via possible purification and screening stages.

Foam-formed fibre webs, i.e. fibre webs formed from a dispersion of fibres in a foamed liquid, are produced in a similar way. A pulp or fibre furnish is thus first prepared in water in a breaker. A certain dewatering occurs thereafter, before the furnish is mixed with a foamable liquid containing tenside and water. The fibres are dispersed in the foam and the foamed fibre dispersion is deposited on a wire, and the main portion of the liquid which is essentially in the form of a foam, is removed by the wire. The technique is described i.a. in GB 1,329,409 and U.S. Pat. No. 4,443,297. The thus-produced fibre webs present a high degree of uniformity in the fibre formation. One problem in connection with foam forming is the recirculation of the foam in the system drained from the wire in a controlled manner with the maintenance of a good balance in the system with respect to the air content and tenside content of the foam.

OBJECT OF THE INVENTION AND THE MOST IMPORTANT FEATURES

The object of the present invention is to achieve a method of producing foam-formed paper webs and other fibre webs, where the aforementioned problems are solved in a simple manner by conveying the foamed liquid which is removed from the wire to a closed foam tank in which a draining of the liquid to the bottom of the tank occurs, whilst the lighter foam is collected in the top of the foam tank. Liquid from the bottom of the foam tank is led to the dispersion vessel via a first pipeline, and the foam passes to the dispersion vessel via a second pipeline (130) in the top of the foam tank where the fibres are added and dispersed in the foamable liquid.

BRIEF DESCRIPTION OF THE DRAWINGS

The invention will now be described in more detail with reference to two embodiments shown in the accompanying drawings.

DESCRIPTION OF EMBODIMENTS

Figure 1:
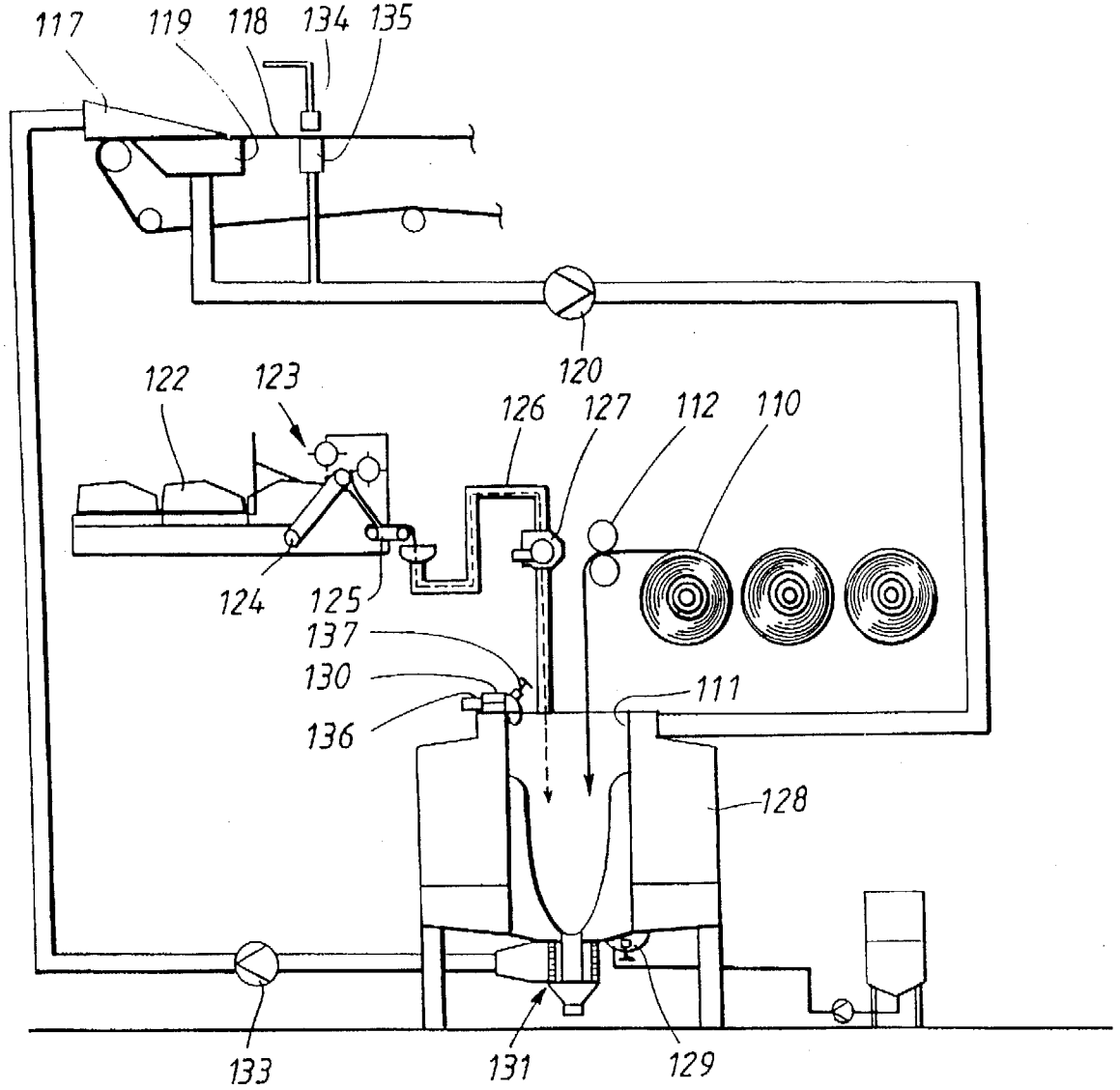
FIG. 1 shows a flow diagram of the method according to the invention.

FIG. 1 shows a process solution for a foam forming process according to the invention. The foam is generated by means of a tenside being added to the water in a pulper 111 where an intensive agitation and air intake occurs. Additional foam generation occurs in the process due to the turbulence which is created in the pumps as well as at the wire 118. A condition for foam generation is however that there is access to air.

The tenside can be of any suitable type; anionic, cationic, non-ionic or amphoteric. GB patent 1,329,409 describes tensides suitable for foam forming of fibre webs. There are however many other available tensides suitable for the purpose. The choice of tenside can for example be affected by factors like the chemical composition of possible other additives to the fibre furnish, like wet-strengtheners, binders, creping chemicals, etc.

A suitable tenside metering in order to achieve a relatively stable foam which is able to maintain a substantially uniform dispersion of fibres in the foam is adjusted for each individual case and is dependent on such factors as the type of tenside, the degree of hardness of the water, the water temperature as well as the type of fibres. A suitable tenside content in the water lies within the range 0,02–1,0 weight-%, preferably however below 0,2 weight-%.

The characteristics of the foam vary with the amount of bound air. At an air content of up to about 70–80%, the air is present in the form of small spherical air-bubbles surrounded by free water, so-called spherical foam. With larger air content the foam transforms into a so-called polyhedral foam where the water is present in the thin membranes between different air bubbles. The latter foam type means that the foam is very stiff and difficult to handle.

In a foam forming process, spherical foam is normally used, i.e. the air content lies between 40–70% . The small air bubbles function as spacers between different fibres, at the same time as the higher viscosity compared with the water damps the turbulence in the liquid and reduces the collision frequency between various fibres and the flock formation caused hereby. The bubble size in the foam is affected by factors like the type of agitator in the pulper/foam generator 111, the agitation speed, as well as the amount and type of tenside. A suitable average diameter of the bubbles is between 0,02 and 0,2 mm.

In the shown embodiment a mixture of cellulose fibres and synthetic fibres is used. Alternatively, only cellulose fibres are used in the case where it is desired to produce paper, e.g. soft paper. The cellulose fibres in the form of easily defiberizable rolled pulp 110 are metered down into the pulper/foam generator 111 at a controlled speed between a feeding roller pair 112 possibly with combined surface weight meter, whereupon this is conveyed through a pre-wetting channel before it is coarsely shredded down into the pulper 111. The coarse shredding of the pulp occurs e.g. between a so-called spiked roller pair. The pre-wetting of the pulp with fresh water is desirable in order to facilitate the dispersion in the pulper. The pre-wetting channel and the coarse shredder have been omitted from the drawing for the sake of simplicity. In the case that the rolled pulp presents a generally uniform surface weight, the metering can occur merely via the feeding speed.

The synthetic fibres are normally provided in the form of bales 122 which, in a known way, are opened by bale openers 123, metered by means of a corrugated belt 124 and disposed on a collection wire 125. The fibres are sucked from the collection wire through a blow line 126 and metered down into the pulper/foam generator 111 via a condenser 127. Other equipment for metering the pulp fibres and synthetic fibres than that shown can of course be used.

In the shown embodiment, the same pulper is used for both fibre types. In certain cases it may be suitable to have separate pulpers for different fibre types, depending on the fact that these can require different processing, or if it is desired to use different types of fibre for so-called multi-layer forming, which is described below.

The pulper/foam generator 111 is concentrically located within a larger tank, the foam tank 128. Whilst the pulper 111 is open upwardly, the foam tank 128 is closed. The two vessels communicate with each other via pipes 129, 130 at the bottom and the top.

An intensive dispersion and mixing of the fibres occurs in the pulper/foam generator 111. At the same time, foam is generated with the assistance of the tenside which is in the water. In order to prevent the foam from rising upwardly and forming a growing foam layer on the top, it is important to maintain a foam circulation between the top and bottom of the pulper/foam generator 111. With a suitably designed rotor aggregate 131 a fully formed vortex is obtained, which gives the desired circulation. The pulper volume is adapted in order to be able to even out rapid variations in the fibre metering. A suitable fibre concentration is 0,1–1,5 weight-%.

The air content in the foam can be measured by weighing a known volume of foamed fibre dispersion. This can occur by continually registering the weight of a certain length of the conduit between the pulper/foam generator 111 and the inlet box 117. Calibration of the measurement scale is effected due to the fact that the weight of said volume filled with the liquid in question, without mixing of air, corresponds to 0% air, whilst the same volume filled only with air corresponds to a 100% air content. Adjustment of the air content can occur for example by means of the addition of tenside, the agitation speed in the pulper/foam generator 111 and/or in that compressed air is released into the pump 133.

The foam with included fibres is pumped into the inlet box 117 on a paper machine with the aid of a suitable pump 133, said machine in the shown example being of Fourdrinier-type. The type of paper machine is however of secondary importance for the invention which can also be used on, for instance, suction breast roller machines and double wire machines. The pump should be able to cope with large amounts of air and at the same time be able to handle long synthetic fibres where these are present, without spinning effects occurring. Several different pump types fulfil these requirements. One example is a conventional piston pump. Another is a vacuum pump of the water-ring type, e.g. of the Helivac-make manufactured by Berendsen Teknik AS. An additional example is a pump type manufactured by Discflo Corp., which has a rotating disc pack with radial gaps.

In the depicted embodiment, the inlet box 117 and the suction box 119 can be considered as an integrated unit. The forming of the fibre web is completely closed, i.e. there is no free fluid surface. A dewatered and ready-formed sheet comes out of the inlet box 117.

The foam—fibre dispersion is divided over the width of the machine to the inlet box 117 and fills the space which is delimited by the end walls of the inlet box and the downwardly sloping upper portion. The foam is sucked through the wire 118 with the aid of the vacuum pump 120 and that remaining on the wire becomes the ready-formed sheet.

It is also imaginable to use so-called multi-layer forming with different fibre types/mixtures in different layers. The various fibre types are then fed separately up to the inlet box which, in this case, is of multi-layer type.

In order to maintain the water balance in the system, the water which disappears with the sheet after forming has to be replaced. One way of doing this is by means of a spray 134 across the formed fibre web. The spray 134 serves moreover as a washing zone in order to minimize the content of tenside in the formed sheet. Addition of the fresh water can also occur at different locations in the system, e.g. at the pre-wetting stage. A separate suction box 135, but one which is coupled to the same circulation stage as above, supplies make-up water to the foam tank 128.

The foam which is sucked through the wire 118 is conveyed via suction box 119 and the vacuum pump 120 to the top of the foam tank 128. An unavoidable amount of leakage air is also conveyed with the foam. The foamtank 128 functions as a buffer tank for the foam.

The foam which is deposited in a vessel will slowly transform from spherical foam into polyhedral foam, said foam types having been described above. In the foam tank 128 the liquid will thus be drained to the bottom of the tank, whilst the lighter foam is accumulated at the top of the tank. The tenside is accumulated in the contact surface between the air and the water. It is therefore likely that the tenside will tend to remain in the lighter foam and thus be concentrated towards the top of the tank.

The liquid phase in the bottom of the foam tank 128 runs over to the pulper 111 via the communicating pipe 129 in the bottom of the tank. In the same way the foam at the top of the foam tank 128 will be forced out via the pipe 130 in the top of the tank due to the over-pressure which is created by the vacuum pump 120. This light foam is very stable and, above all, voluminous and therefore has to be reduced before it is released down into the pulper 111. A high speed propeller 136 mounted in the tube 130 mechanically breaks up the larger air containments and releases a part of the large amount of air which is bound.

A control valve 137 is also arranged in the upper connection pipe 130 between the foam tank 128 and the pulper 111, with the help of which valve the pressure in the foam tank 128 and thereby also the level in the pulper 111 can be kept constant.

By means of the described arrangement, a closed foam loop is obtained which is opened in a controlled manner between the foam tank 128 and the pulper 111. The volume of the foam tank should be dimensioned so that the residence time of the foam in the tank is about 45–180 seconds, preferably 60–120 seconds. A large portion of the liquid content will then be able to drain to the bottom of the tank 128 and thereafter run over to the pulper. At the same time the tank has to be able to contain the lighter foam in the upper part of the tank. A suitable ratio between total volume and the expected liquid volume in the tank is about 4–8, preferably about 6.

The foam thus circulates between the pulper/foam generator 111, the inlet box 117, the wire 118, the suction box 119 and back to the pulper/foam generator 111 via the foam tank 128 in one simple circulation step. A certain addition of tenside and water occurs in order to replace the amount which follows along with the sheet after forming. Make-up water addition can for example be controlled by measuring the differential pressure in the foam tank 128. The tenside content in the foamed fibre dispersion is suitably determined by a surface tension meter.

Figure 2:
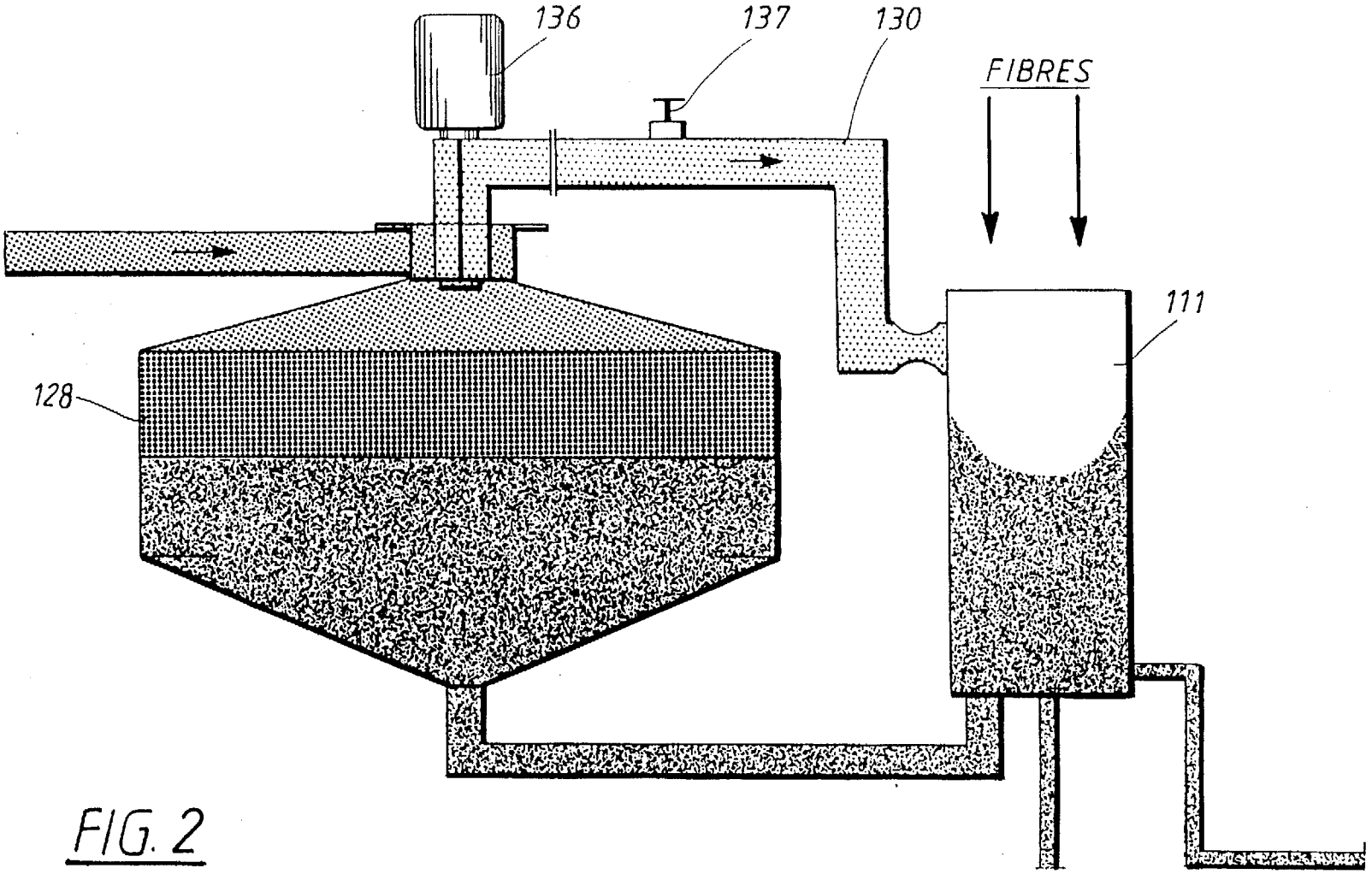
FIG. 2 shows a modified embodiment of the dispersion vessel and the foam tank.

The pulper/foam generator 111 and the foam tank 128 do not of course have to be arranged as an integrated unit, but can be arranged separate from one another as shown in FIG. 2. However, even in this case, they communicate with each other via pipelines 129 and 130. As mentioned above, the system may also comprise two or more pulpers/foam generators which can all still communicate with the same foam tank.

The above-described method of directly metering dry fibres, possibly after pre-wetting, down into the pulper/foam generator 111 is preferred since it allows an easily controlled process with short contact times between the fibres and the carrier medium. The invention can however be applied in a process where a fibre furnish is first formed by dispersing the fibres into a breaker vessel, said fibre furnish being diluted to the desired concentration and added to a foam generation vessel where the addition of tenside occurs.

The formed fibre sheet can be subjected to subsequent treatment stages, e.g. creping for producing soft paper or hydroentangling for producing so-called spunlace material, or just dried.

Fibres of many different types and in different mixing ratios can be used. Mixtures of pulp fibres and synthetic fibres, e.g. polyester, polypropylene, rayon, lyocell (viscose), etc., can thus be used. As an alternative to synthetic fibres, natural fibres with long fibre length, over 12 mm, can also be used, such as seed hair fibres, e.g. cotton, kapok and milkweed; leaf fibres, e.g. sisal, abaca, pineapple, New Zealand hemp; and bast fibres, e.g. flax, hemp, ramie, jute, kenaf. Varying fibre lengths can be used and, with a foam forming technique, longer fibres than those which are possible with conventional wet laying of fibre webs can be used. Long fibres, circa 18–30 mm, are advantageous for hydroentangling since they increase the strength of the material, in both wet as well as dry conditions. An additional advantage with foam forming is that it is possible to produce material with lower surface weight than that which is the case with wet laying. As a replacement for pulp fibres, plant fibres with short fibre length can be used, such as esparto grass, *phalaris arundinacea* and straw from crop seed.

With certain types of fibres, a binder may be desirable in order to give additional strength to the material. Suitable binders include starch-based binders, polyvinyl-alcohol, latex, etc., which are used in order to increase the strength of nonwoven materials.

I claim:

1. Method of producing a foam-formed fibre web comprising the steps of:

forming a foamed fibre dispersion by dispersing fibres in a foamable liquid comprising water and a tenside in a dispersion vessel, and conveying the foamed fibre dispersion to a wire on a paper machine, conveying foamed liquid which is removed through the wire to a closed foam tank, a liquid portion of the foamed liquid draining to a bottom section of the tank, whilst a foam that is lighter than the liquid portion is collected in a top section of the foam tank, conveying the liquid from the bottom section of the foam tank to the dispersion vessel via a first pipeline, conveying the foam, via a second pipeline in the top section of the foam tank to the dispersion vessel, where the fibres are added and dispersed in the foamable liquid, and maintaining pressure in the foam tank substantially constant by means of a regulator valve.

2. Method according to claim 1, wherein the foam in said second pipeline is acted upon mechanically, so that larger air bubbles in the foam are broken up, whereby bound air is released from the foam.

3. Method according to claim 1, wherein air content in the foam is measured by weighing a certain volume of the foamed fibre dispersion between the dispersion vessel and the paper machine.

4. Method according to claim 1, wherein dry fibres are metered directly into the dispersion vessel, whereafter the fibres are dispersed in the foamable liquid which is part of a carrier medium, for forming the foamed fibre dispersion which is conveyed to said wire, and whereafter the foamable liquid, after having passed through the wire, is recirculated to the dispersion vessel via the foam tank in a simple closed circuit.

5. Method according to claim 4, wherein apart from the fibres, fresh water and tenside are added to the closed circuit of the carrier medium, including said foamable liquid, in order to replace the amount which has left the closed circuit with the foam-formed fibre web after forming.

6. Arrangement for producing a foam-formed fibre web according to the method defined in claim 1, said arrangement comprising:

a paper machine provided with a wire, a dispersion vessel for forming a foamed fibre dispersion of fibres in a foamable liquid, means for supplying the foamed fibre dispersion to said wire on said paper machine, means for recirculating the foamable liquid to the dispersion vessel, and a closed foam tank to which the foamable liquid which has passed the wire is conveyed, wherein the foam tank communicates with the dispersion vessel both from its bottom section via a first pipeline and from its top section via a second pipeline, and wherein a regulator valve is arranged relative to said second pipeline, for regulating pressure within the foam tank and thereby the foam volume in the dispersion vessel.

7. Arrangement according to claim 6, wherein means are arranged relative to said second pipeline, for mechanically breaking up larger air bubbles in the foam and thereby release bound air from the foam.

8. Arrangement according to claim 6, wherein the dispersion vessel and the foam tank form an integrated unit in such a way that the dispersion vessel is arranged within the foam tank which thus surrounds the dispersion vessel.

9. Arrangement according to claim 6, wherein the dispersion vessel and the foam tank are arranged as separate, but communicating, vessels.

10. Arrangement according to claim 6, wherein the dispersion vessel further comprises a plurality of dispersion vessels which communicate with a common foam tank.

11. Arrangement according to claim 10, further including means for supplying different fibre types to the plurality of dispersion vessels.

12. Arrangement according to claim 11, wherein the different fibre types are metered separately from the dispersion vessels up to an inlet box of the paper machine, said inlet box being of multi-layer type.

13. Method according to claim 1, wherein the foam-formed fibre web includes a paper web.

14. Method according to claim 1, wherein the foamed fibre dispersion is formed by dispersing natural fibres.

15. Method according to claim 1, wherein the foamed fibre dispersion is formed by dispersing synthetic fibres.

16. Method according to claim 1, wherein the regulator valve is arranged in said second pipeline.

17. Method according to claim 4, wherein dry fibres are pre-wetted after metering, yet prior to be being conveyed to the dispersion vessel.

18. Method according to claim 5, wherein other chemicals, other than tenside, are also added to the closed circuit.

19. Arrangement according to claim 6, wherein the regulator valve is arranged in said second pipeline.

20. Arrangement according to claim 7, wherein said means for breaking up larger air bubbles are arranged in said second pipeline.

* * * * *